US007805865B2

(12) United States Patent
Paske

(10) Patent No.: US 7,805,865 B2
(45) Date of Patent: Oct. 5, 2010

(54) VIBRATORY EXCITER UNIT FOR INTERCHANGEABLE CONNECTION TO VARIOUS VIBRATORY TOOLS

(75) Inventor: Benjamin J. Paske, Slinger, WI (US)

(73) Assignee: M-B-W, Inc., Slinger, WI (US)

( * ) Notice: Subject to any disclaimer, the term of this patent is extended or adjusted under 35 U.S.C. 154(b) by 1302 days.

(21) Appl. No.: 11/331,680

(22) Filed: Jan. 13, 2006

(65) Prior Publication Data

US 2007/0166103 A1 Jul. 19, 2007

(51) Int. Cl.
*E02F 3/04* (2006.01)

(52) U.S. Cl. ..... 37/403; 404/128

(58) Field of Classification Search ..... 37/104, 37/142.5, 403–410; 172/40, 42, 554; 404/83, 404/117, 121, 127, 133.2, 128, 132
See application file for complete search history.

(56) References Cited

U.S. PATENT DOCUMENTS

| | | | | |
|---|---|---|---|---|
| 3,909,149 | A | 9/1975 | Century | |
| 3,930,741 | A * | 1/1976 | Berry | 404/133.2 |
| 4,735,523 | A * | 4/1988 | Ishikawa et al. | 404/133.2 |
| 4,808,027 | A | 2/1989 | Anderson | |
| 4,927,289 | A | 5/1990 | Artzberger | |
| 5,062,228 | A | 11/1991 | Artzberger | |
| 5,244,306 | A | 9/1993 | Artzberger | |
| 5,263,544 | A | 11/1993 | White | |
| 5,526,590 | A * | 6/1996 | Palm et al. | 37/142.5 |
| 7,080,958 | B1 | 7/2006 | Morris | |

FOREIGN PATENT DOCUMENTS

| | | |
|---|---|---|
| DE | 3611191 | 10/1987 |
| EP | 1536068 | 6/2005 |
| JP | 2002038514 | 2/2002 |

OTHER PUBLICATIONS

International Search Report mailed Oct. 15, 2008.

* cited by examiner

*Primary Examiner*—Robert E Pezzuto
(74) *Attorney, Agent, or Firm*—Andrus, Sceales, Starke & Sawall, LLP

(57) ABSTRACT

A vibratory exciter apparatus can be interchangeably connected to a variety of diverse vibratory compaction and other earth-working vibratory tools and includes a vibration-isolating connection link to tool carriers of varying sizes. A vibratory exciter housing is isolated from the connector link and from the carrying tool to which the link is attached by a primary elastomer isolator group which is, in turn, protected from damaging overload in a vertical downward direction by a secondary elastomeric isolator sheet and from damaging vertical load in an upward direction by a tertiary elastomeric isolator sheet. The connecting link utilizes adjustable bushing assemblies to accommodate dimensional differences from one boom manufacturer to another. The vibratory exciter unit includes heat-reducing shrouds for the rotary eccentric weights.

21 Claims, 7 Drawing Sheets

FIG. 3
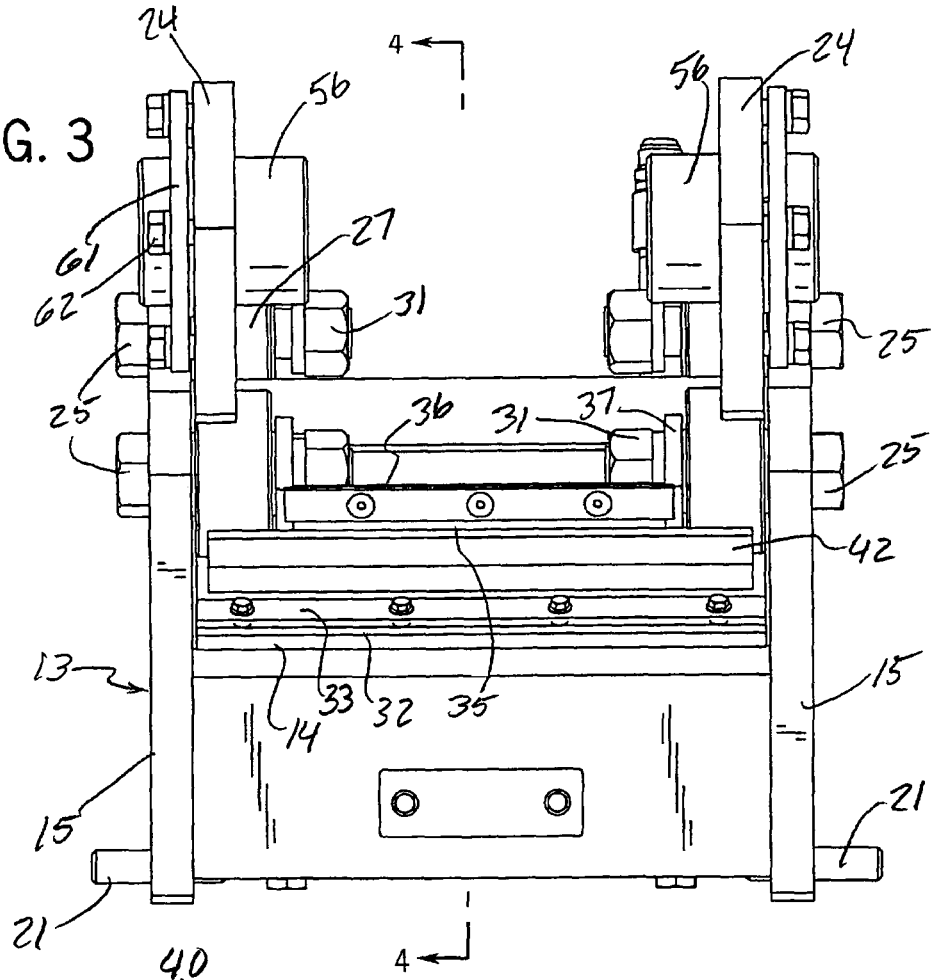
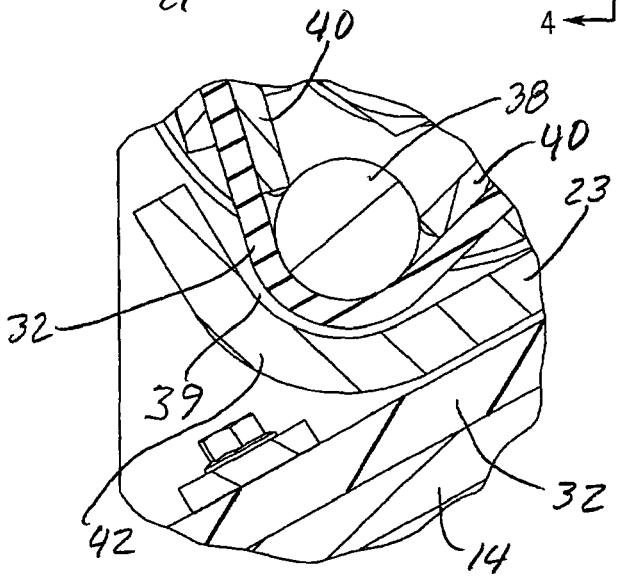
FIG. 4A
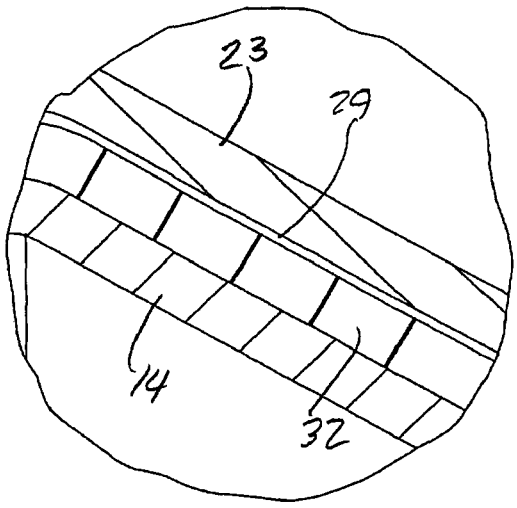
FIG. 4B

VIBRATORY EXCITER UNIT FOR INTERCHANGEABLE CONNECTION TO VARIOUS VIBRATORY TOOLS

BACKGROUND OF THE INVENTION

The present invention pertains to a vibratory exciter unit that is adapted for interchangeable connection to a number of diverse vibratory tools and for vibration isolating connection to a tool carrier.

Many types of soil excavation, compaction and other construction activities utilize vibratory tools of various types to facilitate the particular activity. Such vibratory tools include compaction rollers, compaction plates, vibratory plows, asphalt cutters, concrete breakers and pile and sheet drivers and extractors. Such vibratory tools are often connected to the boom of an excavator or similar off-the-road vehicle such that the boom can be operated to place, maneuver, and apply downpressure to the tool during use. It is important to isolate the vibratory tool from the excavator boom and the machine that operates the boom. It is known in the art to provide elastomer isolators between the boom and the exciter unit, as shown for example in U.S. Pat. No. 5,244,306 which is incorporated by reference herein.

Because of the wide variety of vibratory tools that are made for attachment to an excavator or the like, special connectors and attaching arrangements are often needed to adapt a particular manufacturer's vibratory tool to the boom of an excavator made by a different manufacturer. The typical connection between an excavator boom and a vibratory tool includes a connecting link attached to the boom with two pivot pins, the link is also connected with vibration isolating mounts to the vibratory tool. Differences in boom sizes and connecting pin lengths and diameters require the manufacturers of many vibratory tools to stock a large number of parts to accommodate the connections. With respect to the vibratory tool itself, typically connected to the bottom of the connector mechanism, there is little or no interchangeability when changing from one vibratory tool to another.

Elastomer vibration isolators that operate in shear have long been used, but are not very effective and are subject to failure in high load applications. It is also known in the prior art to use elastomer vibration isolators of an annular construction that operate in compression. Both types may be made from material having a flexibility (durometer) that is a compromise between those applications best handled with softer elastomer materials and applications better handled with harder elastomer vibration isolators. For example, in compacting sand or more granular materials, high amplitude and lower load compaction is preferable, whereas in compacting clay and similar materials, high load, low amplitude vibrations are preferable. It has also been found that in using annular elastomer vibration isolators in high vertical load applications, the elastomer mounts are subject to unacceptably high compression forces as a result of being compressed past their design limits. This often results in destruction of the isolator by loss of the bond by which the isolator is attached to the metal parts to which it is bonded. This results in loss of isolation and the transfer of vibrations back to the boom and to the vehicle to which it is attached

SUMMARY OF THE INVENTION

In accordance with the present invention, a vibratory exciter unit is adapted for interchangeable connection to a number of different types of vibratory tools and may be easily connected to tool carriers of varying sizes. The apparatus includes an exciter housing in which is mounted a rotary vibratory unit and a drive for imparting rotary motion to the vibratory unit. The housing has a pair of generally vertical, laterally spaced side plates that are interconnected by a housing top plate. An upper connector frame has a pair of generally vertical, laterally spaced side frame members that are interconnected by a bottom plate, the bottom plate overlying the exciter housing top plate. Primary vibration isolators provide connections between the housing side plates and the connector frame side members, and secondary vibration isolating means are positioned between the opposed surfaces of the housing top plate and the connector frame bottom plate. Downward vertical load imposed on the vibratory tool by the boom causes initial deflection of the primary vibration isolators. When the vertical load reaches a level approaching the maximum desired compression of the primary vibration isolators, the secondary vibration isolating means is engaged, preventing the primary isolators from becoming overstressed and possible destruction thereof.

The apparatus also includes a common connection means for attaching a variety of selected tools to the exciter housing side plates. Further, the apparatus includes adjustable connectors for attaching upper edge portions of the side frame members to a variety of tool carriers having varying lateral widths.

In a preferred embodiment, each of the primary vibration isolators comprises an annular elastomeric member that is captured in a cylindrical boss extending inwardly from an interior face of the side frame member. A threaded connector extends through the side plate and the open interior of the elastomeric member to provide the vibration-isolated connection between the side plate and the side frame member. This connection is designed to be fail-safe so that the halves will not be able to separate if there is a failure in the isolators.

The apparatus also preferably includes a tertiary vibration isolating means that is positioned between the upper surface of the connector frame bottom plate and a lower surface of an extension plate that is supported by the threaded connector. The secondary and tertiary vibration isolating means comprise sheets of elastomeric material that has a large surface area to thickness ratio.

The sheet of elastomeric material comprising the second vibration isolating means is attached either to the housing top plate or to the connector frame bottom plate and, in a static no-vertical-load condition or loaded up to a predetermined amount is spaced from the other of said plates. Preferably, the sheet of elastomeric material for the secondary vibration isolating means is attached to the housing top plate and spaced from the connector frame bottom plate. The elastomeric material for the primary vibration isolators is selected to provide initial deflection under a downward vertical load imposed by the tool carrier and higher amplitude vibration caused by the exciter, and the elastomeric material for the secondary vibration isolating means is selected to minimize further deflection of the primary deflection isolators under a vertical downward load beyond a selected maximum and still isolate the lower amplitude vibration.

The sheet of elastomeric material comprising an optional tertiary vibration isolating means is attached either to a lower surface of an extension plate supported by the threaded connector or to the upper surface of the bottom plate of the connector frame and, in a static no-vertical-load condition, is spaced from the other of said plates. Preferably, the sheet of tertiary elastomeric material is attached to the extension plate and is spaced from the bottom plate. The elastomeric material for the primary vibration isolators is selected to provide initial deflection under upward vertical load imposed by the tool carrier and vibration amplitude, and the elastomeric material for the tertiary vibration isolating means is selected to prevent deflection of the primary vibration isolators under a vertical upward load beyond a selected maximum.

The tool carrier typically comprises the boom of an excavator which has a connection end with a lateral width less than the distance between the connector side frame members. The tool carrier typically utilizes a connecting pin to connect the boom end to the side frame members. In accordance with another aspect of the invention, the connectors comprise a bushing assembly that is attachable to the side frame members for receipt of the connecting pin and is adjustable axially to establish a width for a close clearance fit of the end of the boom. Most typically, the end of the boom includes a boom arm and a lift arm, each having a connecting pin, the bushing assembly further comprising a pair of axially aligned bushing assemblies for each of the boom arm and the lift arm with the bushings sized to receive the respective connecting pins for pivotal movement therein. Preferably, the bushing assembly includes a clamping ring device that is operative to position the opposed inner ends of each axially aligned bushing pair at the established width of the boom end.

The means for attaching a selected tool to the housing side plates comprises demountable fasteners attachable to the tool and to lower edge portions of the housing side plates with a common bolt hole pattern.

In the preferred embodiment of the invention, the rotary vibratory unit comprises a pair of counterrotating eccentric weights that are each attached to a shaft operatively connected to the drive unit. Each of the eccentric weights comprises a semicylindrical mass attached to the shaft to present exposed generally flat radial face portions. A semicylindrical thin-walled shroud is attached to each semicylindrical mass to enclose the flat face portions and to define with the semicylindrical mass a generally cylindrical shape. The cylindrical shape is preferably closed by generally planar end faces.

BRIEF DESCRIPTION OF THE DRAWINGS

FIG. 3 is an end elevation view of the assembled housing and frame of FIG. 2.

FIG. 4A and 4B are enlarged details taken on lines 4A and 4B, respectively, of FIG. 4.

DETAILED DESCRIPTION OF THE PREFERRED EMBODIMENT

Figure 1:
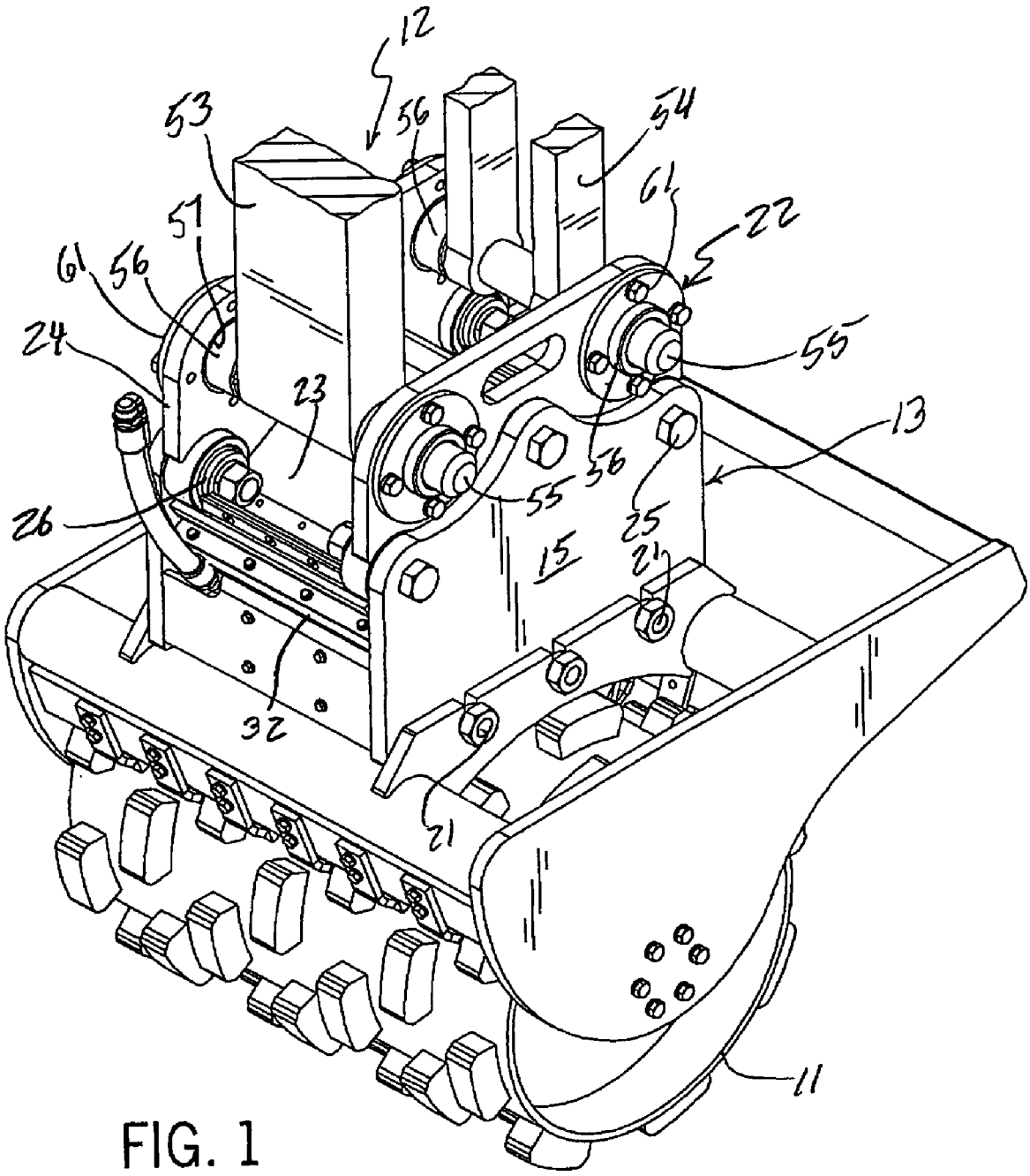
FIG. 1 is a perspective view of the vibratory exciter apparatus of the present invention attached to the boom of a excavator and carrying an exemplary vibratory tool.

FIG. 1 shows the vibratory exciter unit 10 of the present invention having mounted to the bottom a conventional compactor roll as an example of one of many different types of vibratory compaction or other vibratory earth-working tools that can be easily and demountably attached to the exciter unit 10. The exciter unit 10 is connected at an upper region to the boom 12 of an excavator, the boom being typically used to move, position and provide a vertical load to the compactor roll 11 or other vibratory tool mounted to the exciter unit 10.

Figure 2:
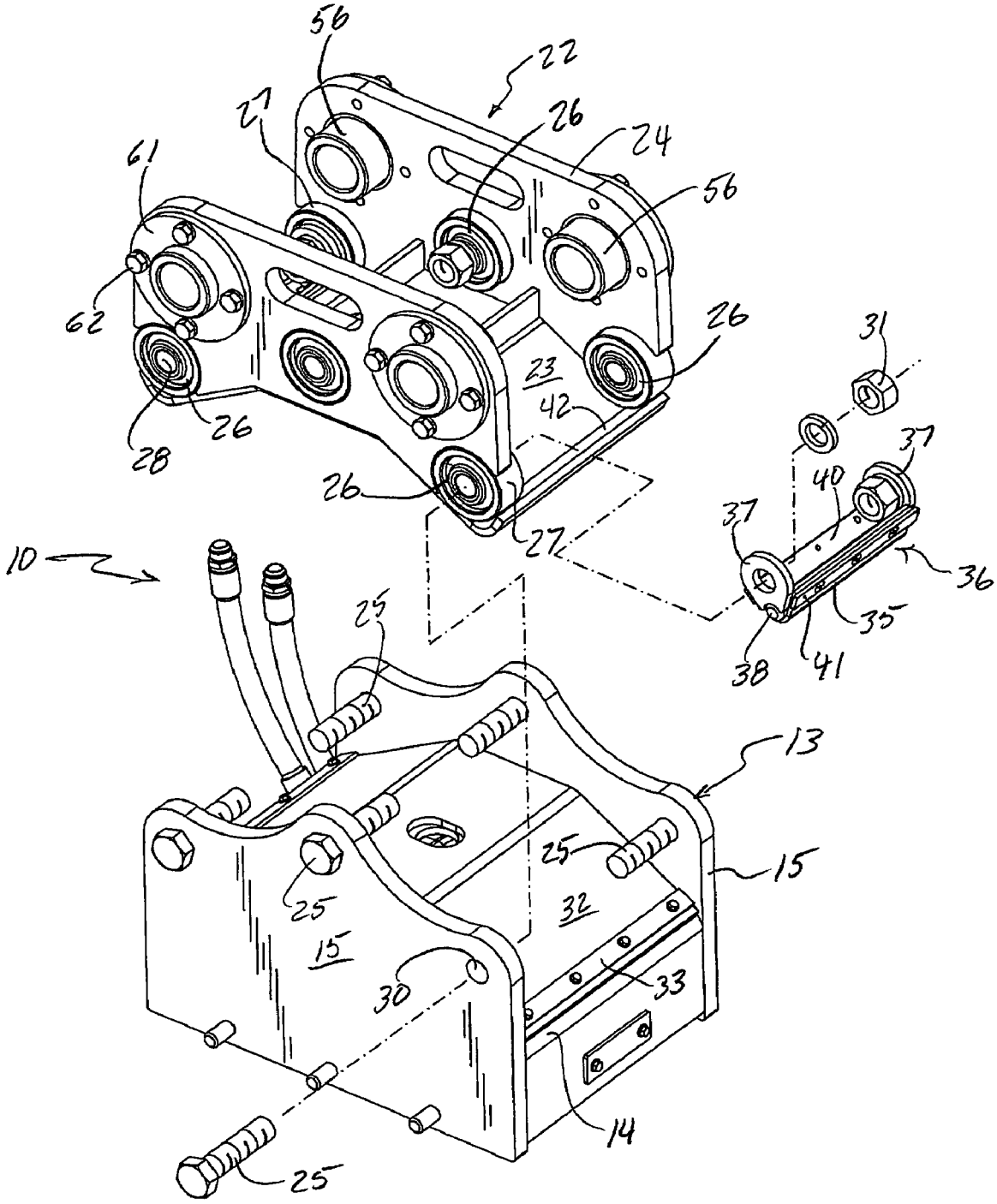
FIG. 2 is an exploded perspective view of the exciter housing and connector frame.

Referring also to FIG. 2, the vibratory exciter unit 10 includes an exciter housing 13 having a generally U-shaped vertical cross section and comprising a housing top plate 14 that interconnects a pair of laterally spaced side plates 15. The top plate 14 is upwardly convex and provides a partial enclosure for a vibratory mechanism 16 suspended from the underside of the plate 14. The vibratory mechanism includes a pair of counterrotating eccentric weights 17 driven by a hydraulic motor 18 (see FIGS. 4 and 7). Details of the construction and operation of a vibratory mechanism of this type are shown in U.S. Pat. No. 4,927,289 which is incorporated by reference herein.

The bottom edges of the housing side plates 15 is provided with a pattern of bolt holes 20 to receive connecting bolts 21 for demountable attachment of the plate compactor tool 11 or any of a number of diverse vibratory tools.

Figure 4:
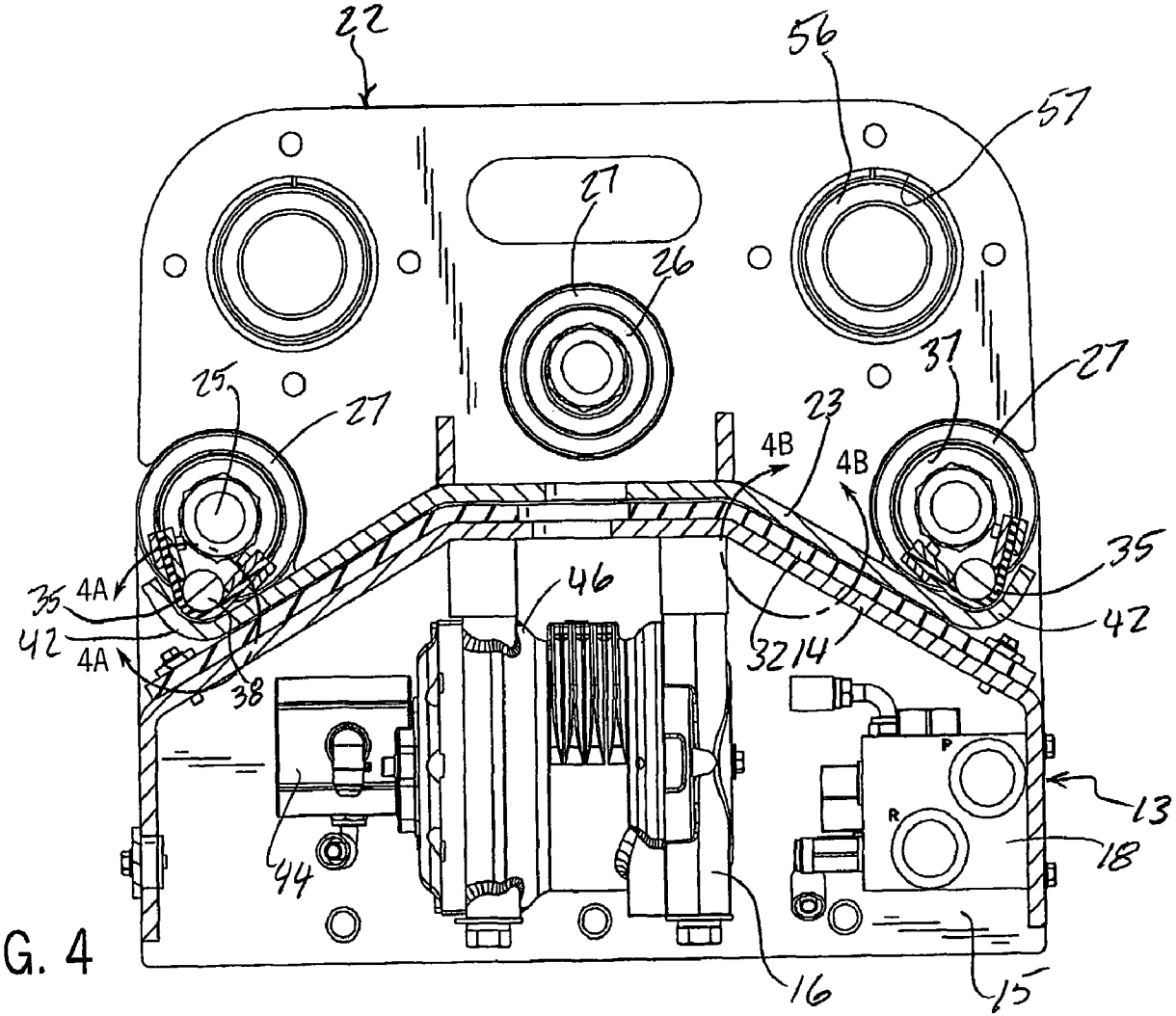
FIG. 4 is a vertical sectional view taken on line 4-4 of FIG. 3.

A connector frame 22 is positioned above and attached to the exciter housing 13. The connector frame is also generally U-shaped in vertical section and includes a bottom plate 23 interconnecting a pair of laterally spaced side frame members 24. The bottom plate 23 is also upwardly convex and, when the connector frame 22 is attached to the exciter housing 13 as will be described hereinafter, the bottom plate 23 overlies and is closely spaced from the upper surface of the top plate 14, as best seen in FIG. 4.

The connector frame 22 fits between the side plates 15 of the exciter housing 13 and is connected thereto with bolts 25, but isolated from the transmission of vibrations by primary vibration isolators 26 at each of the bolted connections.

More specifically, each side frame member 24 is provided with three cylindrical bosses 27, each of which houses a primary vibration isolator 26. Each isolator 26 is of an annular construction and is made from an elastomeric material, either natural or synthetic rubber and having a Shore A durometer of 50. Similar materials of other compressibilities may also be used. Each isolator 26 is bonded to an interior cylindrical sleeve 28 and is held with a tight press fit in a cylindrical boss 27 on the side frame member 24. Thus, the connecting bolts 25 pass through mounting holes 30 in the side plates 15 and through the cylindrical sleeves 28 of the primary vibration isolators 26, the bolts 25 being secured with appropriate nuts 31.

A secondary vibration isolator 32 is positioned between the exciter housing top plate 14 and the connector frame bottom plate 23. Referring particularly to FIGS. 2 and 4, the secondary isolator 32 comprises a sheet of elastomeric material which has a large surface area to thickness ratio. The secondary isolator 32 preferably is made from a fabric reinforced natural or synthetic elastomer and is attached to the upper surface of the housing top plate 14 using fastener strips 33 secured with machine screws 34 or other suitable fasteners. The isolator sheet 32 has a thickness of about ½ in. (about 13 mm) and may have a surface area of about 300 sq. in. (about 2,000 sq. cm.). In the static-at-rest position, with no additional vertical load applied to the apparatus, the upper surface of the secondary isolator sheet 32 is spaced from the undersurface of the connector frame bottom plate 23 by a small amount, approximately ⅛ in. (about 3 mm). See the space 29 shown in the enlarged detail of FIG. 4A.

In use, as the vibratory tool, such as plate compactor 11, is placed on the surface to be compacted by the boom 12, a vertical downward load is exerted on the apparatus, the magnitude of the load depending on the material being compacted. The vibratory mechanism 16 imparts vibration to the exciter housing 13 and plate compactor 11, but the vibrations are isolated from transmission to the connector frame 22 and backhoe boom 12 by the primary vibration isolators 26. As a vertical downward load is imposed on the apparatus, the primary isolators 26 will be compressed and, as the load is increased, the bottom plate 23 of the connector frame will move vertically downward toward the upper surface of the secondary isolator sheet 32. However, before the elastomeric material in the primary isolators 26 is compressed beyond a safe maximum amount, the connector frame bottom plate 23 comes into contact with the secondary isolator sheet 32. The large surface area and somewhat higher hardness (e.g. 80 Shore A durometer) of the secondary isolator prevents compression of the primary vibration isolators beyond their failure thresholds. The secondary isolator 32 continues to provide vibration isolation and, importantly, prevents the connector frame 22 from bottoming out on the exciter housing 13. As the vertical downward load exerted by the boom increases, the initial high amplitude vibrations imposed on the primary vibration isolators 26 decrease in amplitude and, when contact between the bottom plate 23 and the secondary isolator 32 occurs, the amplitude of the vibrations decreases significantly and are absorbed by the secondary isolator 32. This transfer of vibrations from the primary to the secondary isolators prevents a breakdown of the elastomer material in the primary isolators 26 and/or bond between the primary isolator material and the interior cylindrical sleeves 28.

The vibratory apparatus may also be operated in a manner in which the boom 12 imposes a lifting or vertical upward load on the unit, as for example when used as a piling or sheet extractor. In this mode, the primary vibration isolators 26 must also be protected against excessive compression and breakdown in a manner similar to operation under a vertical downward load.

Referring again to FIGS. 2 and 4, tertiary isolator means 35 are positioned between the upper surface of the connector frame bottom plate 23 and the bottom surface of an extension plate 36 which is carried by the bolts 25. More specifically, an extension plate 36 is mounted between each axially aligned pair of bolts 25 extending through the two outermost primary isolators 26 in the end plates 24. Each extension plate 36 includes a pair of opposite mounting rings 37 connected to opposite ends of a circular section rod 38 and to a pair of backing plates 40 that extend parallel to the rod 38 to form a rigid structure. The tertiary isolator 35 comprises a sheet of fabric reinforced elastomer similar to the secondary isolator 32, but having a substantially smaller surface area and a reduced thickness, preferably about ¼ in. (about 6 mm). The tertiary isolator sheet 35 is wrapped around the lower surfaces of the rod 38 and the backing plates 40 and secured thereto with fastener strips 41 and suitable fasteners. The mounting rings 37 are placed on the ends of the bolts 25 and secured with nuts 31 as part of the process of attaching the side plates 15 to the side frame members 24. In the static no-load condition, the lower surface of the tertiary isolator sheet 35 is spaced very slightly from upwardly concave edges 42 on the connector frame bottom plate 23. The no-load spacing is preferably about 0.1 in. (about 2.5 mm). See the space 39 shown in the enlarged detail of FIG. 4B. In a manner similar to operation under a vertical downward load, the primary vibration isolators 26 will compress and absorb vibrations when the boom imposes a lifting force on the apparatus. However, before the elastomer elements in the primary isolators are compressed beyond a selected maximum, the tertiary isolators 35 are engaged, limiting deflection of the primary vibration isolators, yet continuing to provide vibration isolation between the vibratory exciter housing and the boom 12 or other attached machine.

Figure 7:
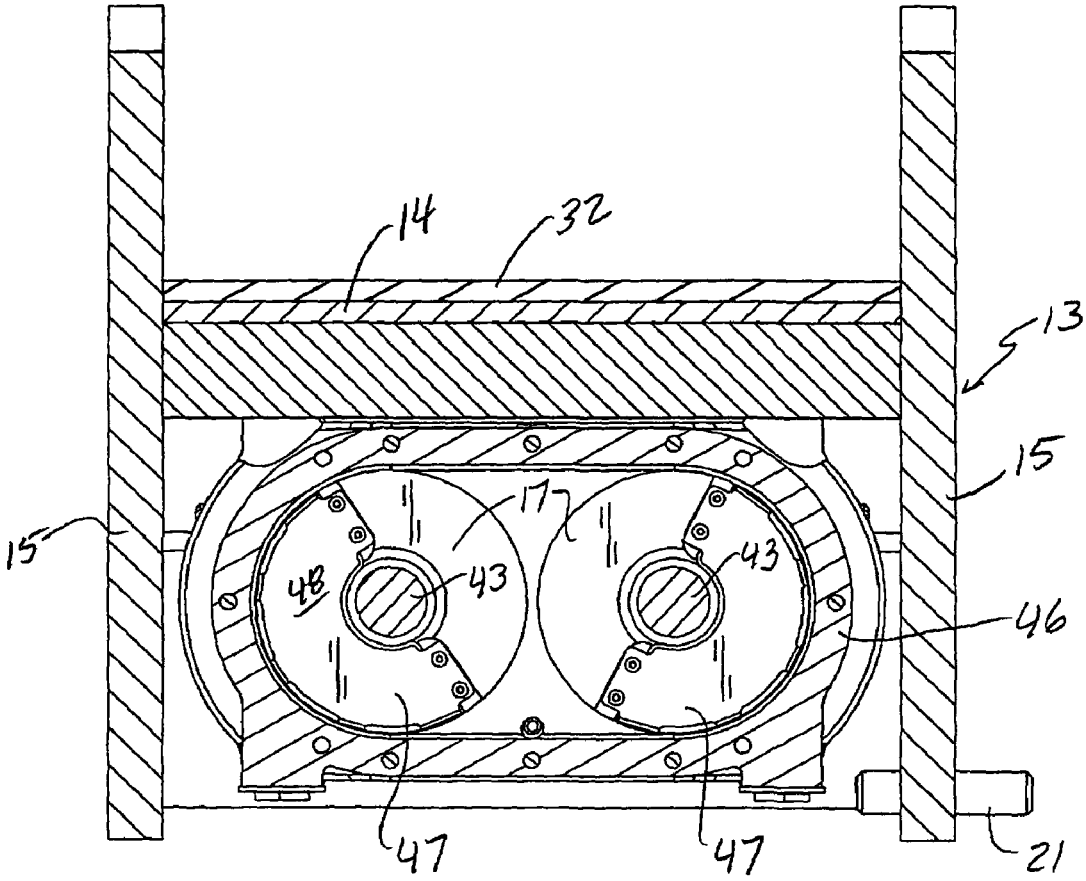
FIG. 7 is a vertical sectional view through the exciter housing showing the exciter casing and shrouded arrangement for the eccentric weights used with the vibratory unit.
Figure 8:
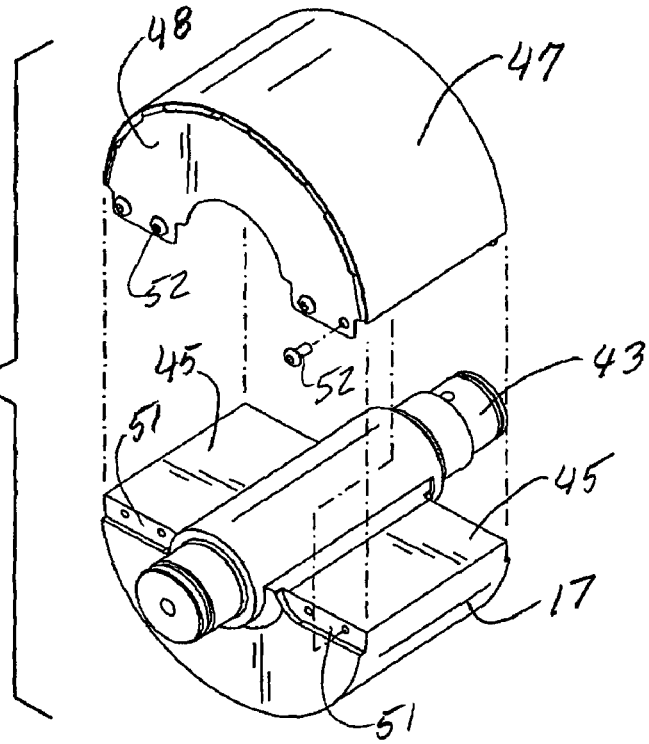
FIG. 8 is an exploded perspective view of a shaft-mounted eccentric weight and shroud.

Referring to FIG. 7, the vibratory mechanism 16 includes a pair of counterrotating eccentric weights 17, as identified above, each of which is mounted on one of a pair of spaced parallel shafts 43. As shown in FIG. 4, a drive linkage 44 from hydraulic motor 18 is operatively connected to the shafts 43 to provide driving rotation to the shafts and weights 17. Each of the eccentric weights comprises a semicylindrical mass having exposed generally flat radial face portions 45 on opposite sides of the shaft 43. The assembly of both eccentric weights 17 and their respective shafts 43 are mounted in a small exciter casing 46 attached to the underside of the housing top plate 14. In operation, the exciter casing 46 contains lubricating oil in which the eccentric weights 17 rotate. It has been found that the flat face portions 45 of the eccentric weights create a great amount of turbulence in the oil which, in turn, leads to excessively high temperatures. Excessively high temperatures can lead to shortened life of elastomeric isolation mounts, lubricants, seals and bearings with consequent higher maintenance costs.

To reduce the generation of high temperatures in the exciter casing 46, each of the eccentric weights 17 has attached to it a semicylindrical thin-walled sheet metal shroud 47. The shroud encloses the flat face portions 45, thereby defining with the semicylindrical mass a generally cylindrical shape which is aerodynamically smoother around its entire outer surface. This shrouding of the eccentric weights has been found to lower the operating temperature of the exciter by as much as one-half. Each of the shrouds 47 includes flat end faces 48 which lie coplanar with the corresponding end faces 50 of the eccentric weight 17. The end faces 50 of the weights, where they intersect the face portions 45, are preferably provided with recesses 51 to accommodate the thickness of the shroud 47 so that the end faces 48 and 50 define a smooth coplanar circular end face. Each shroud 47 may be attached to its respective weight 17 with suitable machine screws 52.

Figure 5:
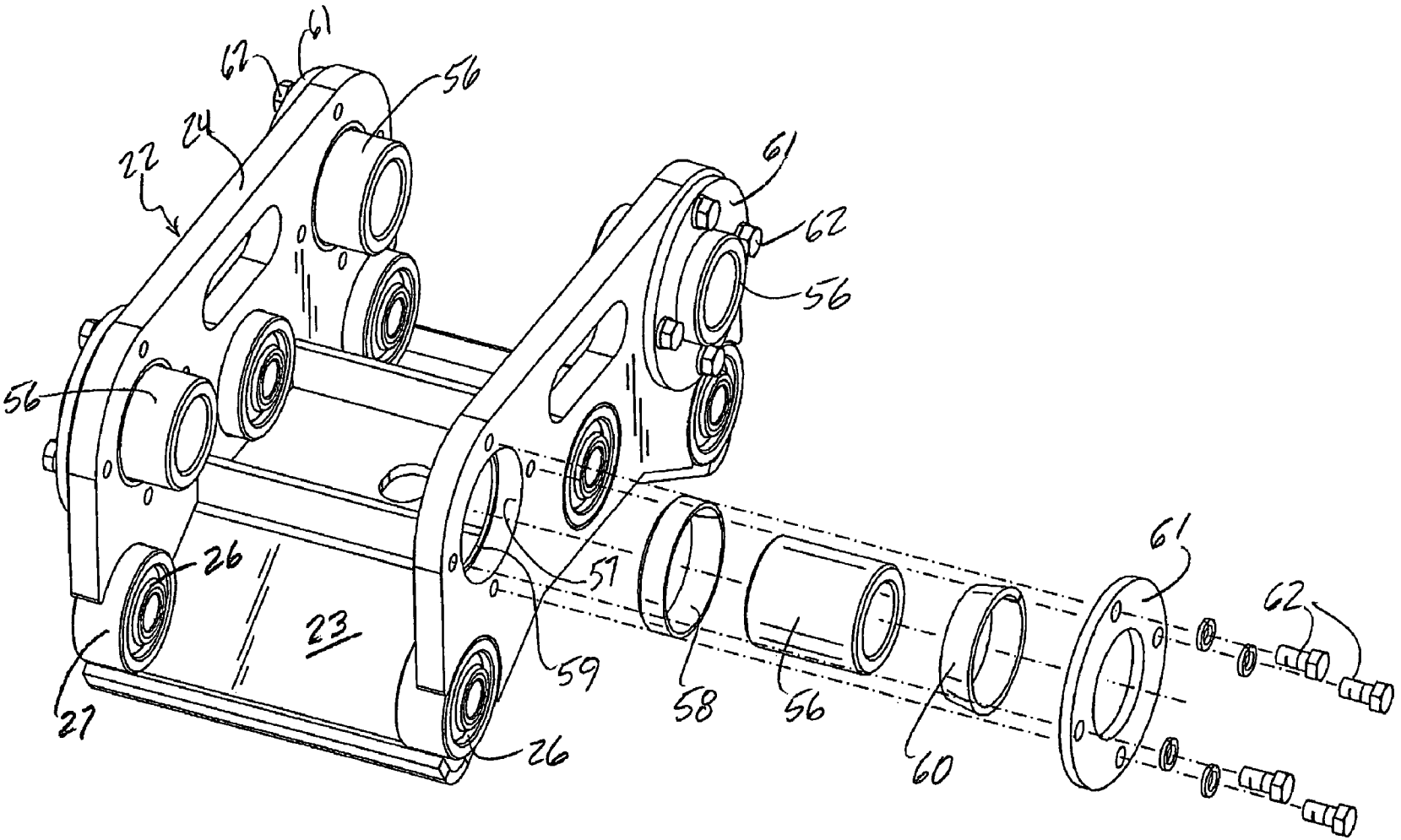
FIG. 5 is an exploded perspective view of the upper connector frame showing the adjustable bushing assemblies for facilitating pinned connection to the boom of a tool carrier.
Figure 6:
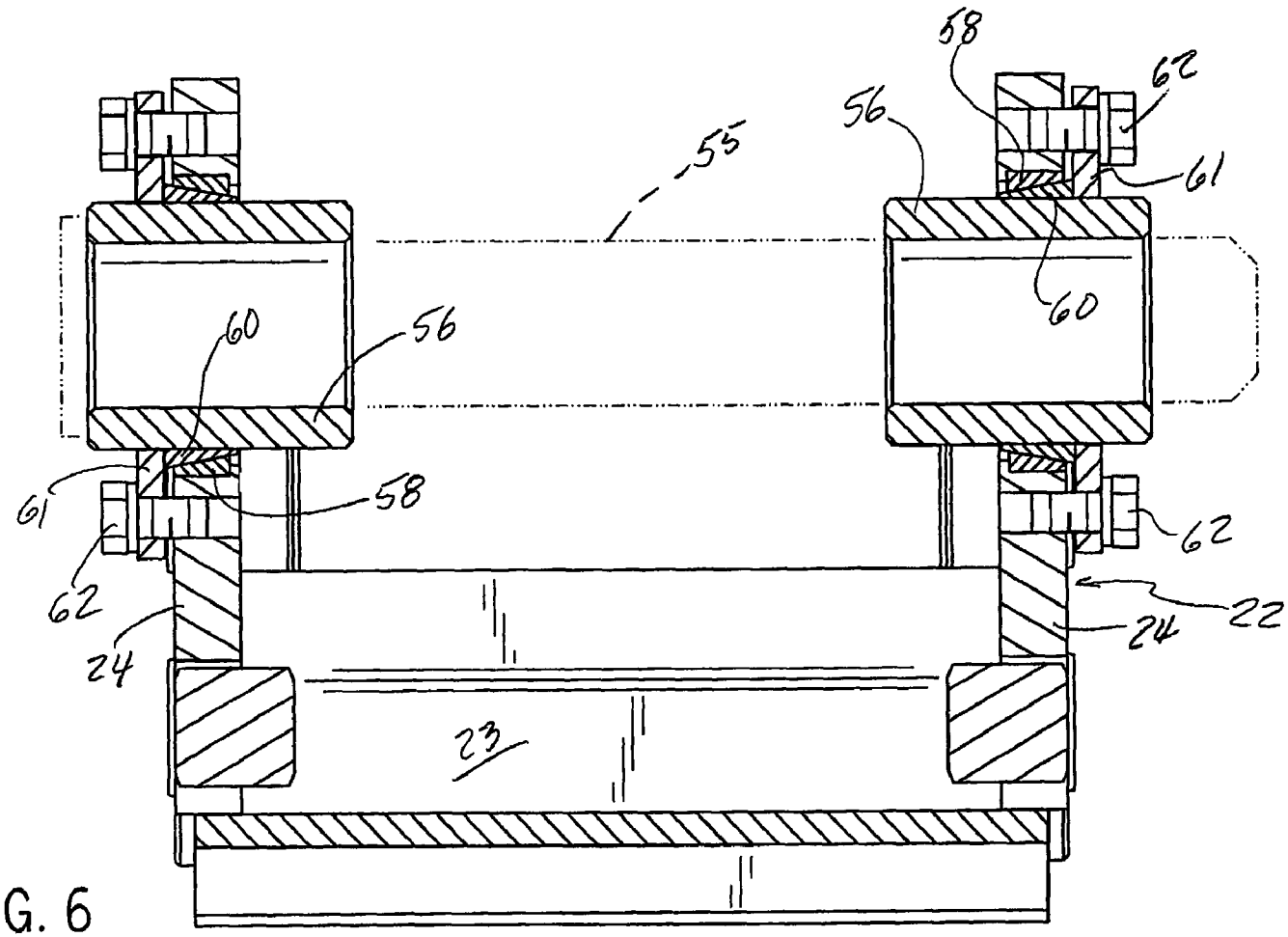
FIG. 6 is a vertical section through the bushing assembly of FIG. 5 in its assembled condition.

Referring now to FIGS. 5 and 6 and again to FIG. 1, the boom 12 of the backhoe or other carrying vehicle typically includes a main boom arm 53 and a lift arm 54. Each of the arms 53 and 54 is attached to the connector frame 22 between the side frame members 24 with a pivotal connection utilizing a pin 55. However, booms 12 from different manufacturers often have varying widths and utilize connecting pins 55 of different diameters. With the ends of the boom arm 53 and lift arm 54 positioned between the connector frame side frame members 24, connecting pins 55 are inserted through the ends of the arm 53 or 54 and through a pair of axially aligned bushings 56 mounted in the side frame members 24. To accommodate variations in widths of the boom and lift arms 53 and 54, of different manufacturers, each of the bushings 56 is adjustably mounted such that it can be moved in an axial direction so that the opposed inner ends of the bushing pair provide a close clearance fit for the ends of the boom arms 53 and 54.

Each bushing assembly includes a bushing 56, that is inserted through an oversize hole 57 in the side frame member 24, the hole 57 having a peripheral lip 59 on the inner edge. The assembly also includes a large diameter compression ring 58 with a tapered ID, a smaller diameter compression ring 60 with a tapered OD, an annular mounting plate 61 and a plurality of mounting bolt assemblies 62. The compression rings 58 and 60 are slid onto the bushing 56, and the bushing and compression rings are inserted from the outside into hole 57. The mounting plate 61 is then placed over the bushing on the outside of the frame member 24 and brought into contact therewith for insertion of the mounting bolt assemblies 62. The inner face of the mounting plate 61 forces the large diameter compression ring into contact with the lip 59 and captures the assembly of compression rings 58 and 60 in the oversize hole 57 and on the OD of the bushing. The bushings 56 of each axially aligned pair are positioned to establish the selected distance between their opposed ends to provide the desired close clearance fit for the end of the boom 12 as described above. When the bushings have been properly positioned, mounting bolt assemblies 62 are tightened causing the mounting plate to bear against the outer edge of the smaller diameter compression ring 60, forcing it into the compression ring 58 causing the rings 58 and 60 to clamp the bushing 56 securely in position.

The bushing assembly eliminates the need to stock bushings of various lengths to accommodate different boom widths. However, pin diameters often vary considerably from one boom manufacturer to another, requiring the stocking of bushings with varying IDs. Nevertheless, the ability to use bushings of a single length cuts dramatically the inventory of bushings.

I claim:

1. A vibratory exciter apparatus adapted for interchangeable connection to a number of diverse vibratory tools and for vibration-isolating connection to tool carriers of varying sizes, said vibratory exciter apparatus comprising:

an exciter housing at least partially enclosing a rotary vibratory unit and a drive unit for imparting rotary motion thereto;

the exciter housing having a pair of generally vertical, laterally spaced exciter housing side plates interconnected by a housing top plate;

an upper connector frame having a pair of generally vertical, laterally spaced side frame members interconnected by a frame bottom plate, said bottom plate overlying said housing top plate, said housing top plate and said frame bottom plate having opposed surfaces;

a plurality of primary vibration isolators providing connections between the housing side plates and the vertical side frame members; and, secondary vibration isolating means between the opposed surfaces of the housing top plate and the frame bottom plate.

2. The apparatus as set forth in claim 1 including means for attaching a selected tool to the housing side plates.

3. The apparatus as set forth in claim 1 including connectors for attaching upper edge portions of the side frame members to a tool carrier of a selected lateral width.

4. The apparatus as set forth in claim 1 wherein each of the primary vibration isolators comprises:

an annular elastomeric member captured in a cylindrical boss extending inwardly from an interior face of the side frame member; and, a threaded connector extending through the side plate and the open interior of the elastomeric member and providing the connection between the side plate and the side frame member.

5. The apparatus as set forth in claim 4 including a tertiary vibration isolating means between the upper surface of the bottom plate of the connector frame and a lower surface of an extension plate supported by the threaded connector.

6. The apparatus as set forth in claim 5 wherein the secondary and tertiary vibrations isolating means comprise sheets of elastomeric material having a large surface area to thickness ratio sufficient to constrain the deflection of the primary vibration isolators within predetermined limits.

7. The apparatus as set forth in claim 6 wherein the sheet of elastomeric material comprising the secondary vibration isolating means is attached to the housing top plate or to the connector frame bottom plate and is in a static no-vertical-load condition, spaced from the other of said plates.

8. The apparatus as set forth in claim 7 wherein the sheet of elastomeric material comprising the secondary vibration isolating means is attached to the housing top plate and spaced from the connector frame bottom plate.

9. The apparatus as set forth in claim 6 wherein the elastomeric material for the primary vibration isolators is selected to provide initial deflection under downward vertical load imposed by the tool carrier and vibration amplitude produced by the exciter, and the elastomeric material for the secondary vibration isolating means is selected to prevent deflection of the primary vibration isolators under a vertical downward load beyond a selected maximum and to isolate the amplitude reduced by virtue of the increased static load.

10. The apparatus as set forth in claim 6 wherein the sheet of elastomeric material comprising the tertiary vibration isolating means is attached to a lower surface of an extension plate supported by the threaded connector or to the upper surface of the bottom plate of the connector frame and is, in a static no-vertical-load condition, spaced from the other of said plates.

11. The apparatus as set forth in claim 10 wherein the sheet of tertiary elastomeric material is attached to the extension plate and spaced from the bottom plate.

12. The apparatus as set forth in claim 6 wherein the elastomeric material for the primary vibration isolators is selected to provide initial deflection under upward vertical load imposed by the tool carrier, and the elastomeric material for the tertiary vibration isolating means is selected to prevent deflection of the primary vibration isolators under a vertical upward load beyond a selected maximum.

13. The apparatus as set forth in claim 3 wherein the tool carrier comprises the boom of an excavator having a connection end with a lateral width less than the distance between the connector frame side frame members, and a connecting pin for connecting the boom end to the side frame members; and wherein the connectors comprise a bushing assembly attachable to the side frame members for receipt of the connecting pin and adjustable axially to establish a width for a close clearance fit of the connecting end of the boom.

14. The apparatus as set forth in claim 13 wherein the connection end of the boom includes a boom arm and a lift aim, each of said boom arm and said lift arm having a connecting pin, and further comprising:

a pair of axially aligned bushing assemblies for each of the boom arm and the lift arm and sized to receive the respective connecting pin for pivotal movement therein.

15. The apparatus as set forth in claim 14 wherein the bushing assembly includes a clamping ring device operative to position the opposed inner ends of each axially aligned bushing pair at said established width.

16. The apparatus as set forth in claim 2 wherein the attaching means comprises demountable fasteners attachable to the tool and to lower edge portions of the housing side plates provided with a common bolt hole pattern.

17. The apparatus as set forth in claim 1 wherein the rotary vibratory unit comprises:

a pair of counterrotating eccentric weights operatively connected to the drive unit;

said eccentric weights each comprising a semicylindrical mass having exposed generally flat radial face portions; and, a semicylindrical thin-walled shroud attached to the semicylindrical mass and enclosing the flat face portions to define with the semicylindrical mass a generally cylindrical shape.

18. The apparatus as set forth in claim 17 wherein the cylindrical shape is closed by generally planar end faces.

19. A vibratory exciter apparatus adapted for attachment to a vibratory tool and for vibration-isolating connection to tool carriers of varying sizes, said vibratory exciter apparatus comprising:

an exciter housing at least partially enclosing a rotary vibratory unit and a drive unit for imparting rotary motion thereto;

the exciter housing having a pair of generally vertical, laterally spaced exciter housing side plates interconnected by a housing top plate;

an upper connector frame having a pair of generally vertical, laterally spaced side frame members interconnected by a frame bottom plate, said bottom plate overlying said housing top plate, said housing top plate and said frame bottom plate having opposed surfaces;

primary vibration isolating means providing connection between the housing side plates and the vertical side frame members; and, secondary vibration isolating means between the opposed surfaces of the housing top plate and the frame bottom plate.

20. The apparatus as set forth in claim 19 including attachment means on the exciter housing for interchangeable connection to a vibratory tool selected from the group consisting of compaction roller, compaction plate, vibratory plow, asphalt cutter, concrete breaker and pile and sheet driver and extractor.

21. The apparatus as set forth in claim 20 wherein the attachment means comprises bolted connections of the vibratory tool to the exciter housing side plates.

* * * * *